US009067429B2

(12) United States Patent
Heuft

(10) Patent No.: US 9,067,429 B2
(45) Date of Patent: Jun. 30, 2015

(54) METHOD AND APPARATUS FOR OBTAINING HOMOGENEOUS INK FOR INKJET DEVICES

(71) Applicant: SIMACO GmbH, Burgbrohl (DE)

(72) Inventor: Bernhard Heuft, Burgbrohl (DE)

(73) Assignee: SIMACO GMBH, Burgbrohl (DE)

( * ) Notice: Subject to any disclaimer, the term of this patent is extended or adjusted under 35 U.S.C. 154(b) by 0 days.

(21) Appl. No.: 14/345,912

(22) PCT Filed: Sep. 19, 2012

(86) PCT No.: PCT/EP2012/068470
§ 371 (c)(1),
(2) Date: Mar. 19, 2014

(87) PCT Pub. No.: WO2013/041589
PCT Pub. Date: Mar. 28, 2013

(65) Prior Publication Data

US 2014/0225965 A1 Aug. 14, 2014

(30) Foreign Application Priority Data

Sep. 20, 2011 (DE) ..... 10 2011 113 664

(51) Int. Cl.
*B41J 2/09* (2006.01)
*B41J 2/185* (2006.01)

(52) U.S. Cl.
CPC ..... *B41J 2/185* (2013.01)

(58) Field of Classification Search
USPC ..... 347/73, 74, 77, 82, 90
See application file for complete search history.

(56) References Cited

U.S. PATENT DOCUMENTS

| | | | | |
|---|---|---|---|---|
| 3,769,630 | A * | 10/1973 | Hill et al. | 347/80 |
| 4,027,310 | A | 5/1977 | Baker et al. | |
| 4,268,836 | A | 5/1981 | Huliba et al. | |
| 4,308,543 | A * | 12/1981 | Shultz | 347/38 |
| 4,381,513 | A * | 4/1983 | Ebi et al. | 347/77 |
| 4,442,440 | A * | 4/1984 | Elchinger | 347/74 |
| 4,596,990 | A * | 6/1986 | Hou | 347/41 |
| 6,758,555 | B2 * | 7/2004 | Bajeux | 347/77 |
| 7,175,263 | B2 | 2/2007 | Colombat et al. | |
| 7,393,086 | B2 * | 7/2008 | Otte et al. | 347/77 |
| 2008/0284835 | A1 | 11/2008 | Panchawagh et al. | |
| 2010/0295912 | A1 | 11/2010 | Xie et al. | |

FOREIGN PATENT DOCUMENTS

| | | | |
|---|---|---|---|
| CN | 1796117 | A | 7/2006 |
| DE | 2331803 | A | 1/1974 |
| EP | 1219430 | A1 | 7/2002 |
| EP | 1319512 | A1 | 6/2003 |
| JP | 56116463 | A | 9/1981 |

OTHER PUBLICATIONS

Office Action issued in related application CN201280045687.X with English translation, Feb. 27, 2015, 14 pages.

* cited by examiner

*Primary Examiner* — Anh T. N. Vo
(74) *Attorney, Agent, or Firm* — Drinker Biddle & Reath LLP

(57) ABSTRACT

In order to obtain homogeneous ink for CIJ printers, an inkjet is divided into individual equally large ink droplets, at least part of the ink droplets is provided with an electric charge, and the ink droplets are guided by a deflection device. The ink droplets which are deflected by a predefined amount are collected by a homogenization droplet catcher and are used for printing.

11 Claims, 2 Drawing Sheets

(State of the art)

METHOD AND APPARATUS FOR OBTAINING HOMOGENEOUS INK FOR INKJET DEVICES

CROSS REFERENCE TO RELATED APPLICATIONS

This application is a National Stage Entry application of PCT Application No. PCT/EP2012/068470, filed Sep. 19, 2012, which claims the priority benefit of German Patent Application No. 10 211 113 664.2, filed Sep. 20, 2011, the contents of all being incorporated herein by reference.

BACKGROUND

Disclosed herein is a method and an apparatus for obtaining homogeneous ink for inkjet devices, with equipment for generating an ink jet, with a nozzle arrangement comprising an ultrasonic oscillator and a nozzle for dividing the ink jet into individual equally large ink droplets, with a charge tunnel with which at least some of the ink droplets are provided with an electric charge, with a deflection device with which the individual electrically charged ink droplets are deflected, and with a homogenization droplet catcher.

In continuous inkjet printers (CIJ printers), an ink jet 12 (see FIG. 1) emerges at pressure from the printhead 10 via a nozzle. This jet 12 is modulated via a piezoelectric transducer which is located behind the nozzle, with the result that a uniform breakup into individual droplets 16 is achieved (Rayleigh's droplet breakup). The detaching droplets 16 are electrostatically charged to a greater or lesser degree via a charge tunnel 18. The 10 to 40 m/s fast droplets 16 then fly through a larger deflection electrode 20, where they are deflected laterally or vertically by different, specific electric charge states. Depending on the type of device, the charged or uncharged droplets 16 now reach the surface 21 to be printed on. Droplets 16 that are not needed are already deflected at the printhead in a customary droplet catcher 22, collected and fed to the ink system again. It is known from European Patent Document No. 0 362 101 to inspect and control the speed of the droplets, the quality of the ink and the formation and charging of the droplets in order to achieve a high print quality.

An inkjet matrix printer (CIJ printer) with two gutters is known from German Patent Document No. OS 23 31 803. The first gutter generates control signals for the synchronization of the droplet formation and the charging of the droplets. At inspection intervals, the second gutter collects unused droplets, which have a very high charge compared with the droplets used for the printing, whereby system errors, such as errors in the deflection voltage or in the font size, are detectable.

In the abstract of Japanese Patent Document No. 56 113 463 A, a two-part droplet catcher for a CIJ printer is described which collects undeflected droplets and droplets which have the opposite charge to the droplets that are used for the writing. These oppositely charged droplets are used to determine the ink viscosity.

Special inks are used in CIJ printers. These inks are composed of dyes, binders and solvents. According to requirements, additional salts, quaternary ammonium compounds or other agents can be contained in order to increase the conductivity of the ink. Moreover, adhesion promoters, as well as agents for increasing or lowering the surface tension, can be contained. Besides dyes, pigments can also be used to colour the ink. While dye inks produce more brilliant colours by comparison, pigment inks display the advantage that they run less on the surface to be printed on and are more true and display higher contrast.

It is particularly important in the CIJ printing process that the ink is as homogeneous as possible, in order that ink droplets that are as uniform as possible form. The ink droplets are to have a consistent droplet breaking length, droplet speed, mass and electrical chargeability. The homogeneity of the ink is a prerequisite for being able to divide the ink jet into small droplets with constant chemical and physical properties. In particular, the chargeability in relation to the weight is decisive here, because only when the droplets have a particular charge/mass ratio can they be directed onto their allotted place in the writing matrix. A non-uniform droplet formation therefore leads to poorly controllable or straying ink droplets, which result in a deterioration of the typeface of the printhead.

In order to produce inks with as high as possible a degree of homogenization, care is conventionally taken that the individual components of the ink have as high as possible a solubility and dispersibility, and procedural means which result in as high a homogeneity of the ink as possible are chosen. In particular, the ink is filtered several times during the production. Moreover, until now, the ink has been matched in each case precisely to the device in which the ink is to be used (see European Patent Document No. 0 438 427).

The poorer the quality of the ink used is, the more difficult the adjustment of the printhead proves to be. Ink with a deficient quality leads to an acceptable print result only in the case of an exactly adjusted printhead. This can have the result that the print result deteriorates drastically even in the case of a slight change in the ink consistency or a variation of the ambient conditions. In contrast, ink with optimum quality can be used in a wide adjustment range without resulting in an impairment of the print image.

SUMMARY

Disclosed herein is a method and an apparatus to provide a cleaner typeface in CIJ printing. In the method for obtaining homogeneous ink for inkjet devices: an ink jet is divided into individual equally large ink droplets, at least some of the ink droplets are provided with an electric charge, the ink droplets are guided by a deflection device, the ink droplets which are deflected by a predefined amount are collected by a homogenization droplet catcher and the ink droplets collected by the homogenization droplet catcher are used for printing.

Each ink droplet is preferably provided with the same electric charge. "Each ink droplet" means only the ink droplets which are used to obtain the homogeneous ink for inkjet devices. The ink droplets necessary for the phasing are also only slightly charged in the method according to various embodiments of the invention, and are not meant by this. As is yet to be explained below, the method according to these embodiments can moreover be combined with a CIJ printing process in such a way that ink droplets which are not needed for the printing and phasing are used to obtain homogeneous ink. "Each ink droplet" therefore relates only to these last-named ink droplets.

The flight length of the ink droplets which are used to obtain the homogeneous ink is preferably greater than that in the case of CIJ printing. The flight length is preferably more than 50 mm, in particular more than 70 mm. The longer the flight path of the ink droplets and the larger the deflection, the more narrow the particle-size fraction of the ink droplets collected by the homogenization droplet catcher and the more homogeneous the obtained ink.

The ink droplets which are collected by the homogenization droplet catcher are preferably stored in an intermediate container.

The ink droplets are preferably deflected more strongly than in CIJ printing, in order that inhomogeneities of the ink droplets have a particularly clear effect.

This object is furthermore achieved by an apparatus with the following features: equipment for generating an ink jet, a nozzle arrangement, comprising an ultrasonic oscillator and a nozzle, for dividing the ink jet into individual equally large ink droplets, a charge tunnel, with which at least some of the ink droplets are provided with electric charge, a deflection device, with which the individual electrically charged ink droplets are deflected, and a homogenization droplet catcher, which is arranged at a distance from the undeflected flight path of the ink droplets.

The deflection device preferably generates an electrostatic or magnetostatic field for deflecting the ink droplets.

The apparatus preferably has an intermediate container for storing the ink droplets collected by the homogenization droplet catcher.

The apparatus can be usable both for obtaining homogeneous ink and for printing on a surface using the homogeneous ink. For this, it has equipment for holding and guiding a substrate with a surface to be printed on and a droplet catcher which is arranged such that it collects the undeflected ink droplets not needed for the printing.

The equipment for holding and guiding the substrate with the surface to be printed on and the homogenization droplet catcher are preferably arranged on opposite sides of the droplet catcher for the undeflected ink droplets. In particular, the equipment for holding and guiding the substrate with the surface to be printed on can be arranged above the droplet catcher for the undeflected ink droplets and the homogenization droplet catcher can be arranged below the droplet catcher for the undeflected ink droplets.

The homogenization apparatus according to various embodiments has substantially the same structure as a conventional inkjet printhead, wherein only one homogenization droplet catcher is provided outside the undeflected flight path, with the result that only those ink droplets which were deflected by a corresponding amount are collected. The inkjet printhead can be one for multi-deflection CIJ printing or one for binary CIJ printing. In multi-deflection CIJ printing, a series of individual ink droplets is generated by way of a printhead with a single nozzle opening, and the point at which an ink droplet strikes the surface to be printed on is controlled by the extent of the deflection, which is in turn controlled via the charge of the droplet. In binary CIJ printing, by way of a printhead with a large number, e.g., 192 or 256, of nozzle openings, a corresponding large number of ink jets, i.e., of series of ink droplets, is generated and the point at which an ink droplet strikes the surface to be printed on is determined by the position of the corresponding nozzle opening on the printhead, wherein all ink droplets receive either no electric charge or the same electric charge depending on whether a character or a space is to be printed.

In the method described below, a raw ink which has approximately the required properties in respect of viscosity and conductivity is expediently prepared first. From this ink, an ink jet is generated which is divided into individual equally large droplets by way of an ultrasonic oscillator and a nozzle. The ink jet is provided with a charge via a charge device, with the result that each droplet which detaches from the ink jet has a charge. A deflection device deflects the charged droplets from their original flight path and guides the ink droplets to the homogenization droplet catcher. Only the droplets, the deflection of which corresponds to the position of the homogenization droplet catcher, are received by the homogenization droplet catcher and conveyed to an intermediate container. Droplets which undergo a deflection differing from the predefined value because of inhomogeneities or impurities in the ink do not strike the homogenization droplet catcher and are not conveyed into the intermediate container, with the result that an effective separation between homogeneous and inhomogeneous constituents of the ink can thus be brought about. Only droplets which are optimally formed and have almost no inhomogeneities or impurities any more collect in the intermediate container. An ink which breaks down into droplets, has a high linearity and repeat accuracy and thus a very clean typeface is thus obtained.

Ink droplets which are not received by the homogenization droplet catcher strike a deflector plate, off which they drip and can be collected in a separate collecting container. The deflector plate is preferably arranged behind the homogenization droplet catcher in the direction of flight of the droplets. The ink collected in the collecting container can be recycled and fed to the homogenization device again.

In practice, the problem arises that directly successive ink droplets influence each other's flight path because of electrostatic forces and in particular because of slipstream effects. The slipstream of a preceding ink droplet alone can lead to a stronger deflection of the following droplet, even if the droplets have an identical charge/mass ratio. It is even possible that the following droplet achieves a higher speed because of the slipstream and overtakes the preceding droplet. These effects have a disruptive effect, in particular at the start of the homogenization process. Over time, a balance is then reached in which all ink droplets which have an identical charge/mass ratio are then deflected onto identical paths. The homogenization process described herein is, like the CIJ printing process, adjusted at short intervals of a few seconds in order to compensate for temperature fluctuations, pressure changes and changes in similar operating parameters, and to carry out a phasing. After each adjustment, the homogenization process is started again, and it is necessary to wait until the balance has been reached again. Because of the frequent interruptions, in particular the slipstream effect occurring, when the homogenization process is started again has a disruptive effect.

There are various possibilities for compensating for the mutual influencing of the ink droplets. The technically simplest solution is to position the homogenization droplet catcher in the stabilized flight path of the ink droplets, i.e., where the ink droplets strike, once the initial disruptions due to charge and slipstream effects have abated. A disadvantage of this solution is the somewhat reduced yield, as in each case the first approximately 5 to 8 droplets do not strike the homogenization droplet catcher irrespective of their consistency and thus more ink than necessary is discarded at first. In this case, it therefore makes sense to collect the ink droplets discarded at first and feed them to the homogenization apparatus again.

Alternatively, the charge of the individual ink droplets can also be determined empirically and controlled depending on the number of ink droplets flying ahead. The charge of the ink droplets is successively reduced until the flight path of the ink droplets has stabilized. In this way, although no ink droplets are lost, an additional non-linear control is needed, whereby both operation and maintenance of the apparatus become more expensive.

A further alternative consists in generating very highly charged and uncharged or only slightly charged ink droplets alternately. The distance between the individual very highly charged ink droplets is then so great that they no longer influence each other. In order to increase the distance between the very highly charged ink droplets, it is also possible to charge only every third, fourth, etc., ink droplet very highly. In this method, although the yield is likewise greatly reduced, the highest and most stable separation effect can be achieved. The only slightly charged droplets can be used for the phasing.

It is also possible to load the ink droplets alternately with charges of different polarization. The ink droplets are then deflected alternately upwards and downwards (in the geometry of the figures), with the result that, again, no mutual influencing of the flight paths of successive ink droplets occurs. However, a further homogenization droplet catcher which receives the oppositely polarized ink droplets must then be provided.

The individual methods for avoiding the mutual influencing of the flight paths of the ink droplets can also be combined with each other for optimization.

The degree of deflection of the charged ink droplets depends on their charge/mass ratio. The selection of the charge/mass ratio can be set via the position of the homogenization droplet catcher, the ink pressure, the charging voltage, deflection voltage, as well as via the distance of the homogenization droplet catcher from the charge tunnel. The separation effect of the homogenization device can be determined via the distance between the charge tunnel and the homogenization droplet catcher, as well as via the strength of the deflecting field.

The charge actually applied to an ink droplet depends on the conductivity of the ink between the discharge nozzle and the break-off point. Changes in the conductivity of the ink in this area lead to different charging of the ink droplets. The position of the break-off point depends on the speed or the pressure of the ink, as well as the drive voltage of the nozzle. Locally occurring changes in the viscosity or in the surface tension, caused by inhomogeneities of the ink, lead to changes in the break-off length and thus to a change in the charge of the ink droplets concerned.

The deflecting field can be an electrostatic field which is generated by one or more high-voltage electrodes. However, the deflection of the ink droplets can also be realized via a magnetic field.

Depending on the long-term stability of the ink, the homogenization process can be carried out at the ink manufacturer or immediately before the printing. If the ink has a high long-term stability, it is advantageous to carry out the homogenization already during the ink manufacture and to provide the finished ink product to the user.

Alternatively, the ink can also be produced by a homogenization device directly in the user's printing device, wherein the ink is conveyed from the homogenization droplet catcher into an intermediate container, from which the printhead then draws the ink for printing. As the ink in this configuration is produced "on demand", i.e., only when the printhead needs ink, a certain lead time is to be provided, during which the homogenization device produces the ink needed.

It is also possible that the printhead itself is used both as a printing device and as a homogenization device. For this purpose, the printhead also requires, in addition to the customary droplet catcher, a homogenization droplet catcher for carrying out the homogenization process. In idle periods, the printhead can then draw the raw ink from a first reservoir, carry out a homogenization of this ink, and guide the filtered ink into an intermediate container. For printing, the printhead then draws the filtered or homogenized ink from the intermediate container. An advantage of this combined embodiment is that exactly the same printhead is used both for printing and for homogenizing the ink. Ink which has already shown in the homogenization process that it can be formed by this printhead into ink droplets with the desired charge/mass ratio will very probably also be able to be broken down into uniform ink droplets again in a subsequent printing process. In this embodiment, the above-mentioned possibility of alternately opposing charging of the droplets can be used in such a way that the negatively charged droplets are used for printing and, where appropriate, strike the customary droplet catcher, while the positively charged droplets are used for the homogenization and strike the homogenization droplet catcher or the deflector plate.

Generally, the nozzle arrangement of the homogenization device should be of the same construction as that of the write head of the inkjet device. The diameter of the nozzle of the homogenization apparatus should be the same as or smaller than the diameter of the nozzle used in the write head, and the operating frequency of the homogenization apparatus should be the same as or greater than the operating frequency of the write head. In this way, it is guaranteed that the homogenized ink also forms homogeneous ink droplets in the write head of the inkjet device, and results in a cleaner typeface.

An advantage that can be achieved with this is that a high-quality typeface can be achieved because of the increased homogeneity of the ink used. In addition, the ink can be used without difficulty over a wide adjustment range.

A further advantage is that even with pigment inks, which usually have a lower homogeneity than dye inks, stable ink compositions can be achieved which are optimally suitable for CIJ printing. Any pigments can be used for pigment inks. $TiO_2$ pigments are preferably used. The pigments typically have a diameter of from 0.5 to 2 μm for CIJ applications. The ink droplets usually have a size of from 50 to 120 μm. A typical unfiltered pigment ink therefore corresponds to a Gaussian-distributed liquid, i.e., the size distribution of the pigments dissolved in the ink approximately corresponds to a Gaussian distribution. As the size of the pigments influences the chemical and physical properties of the respective ink droplet, it is possible, with the homogenization device described herein, to make a selection from the Gaussian-distributed pigment ink, the charge/weight ratio of which as well as the bandwidth of which are predetermined exactly.

The particles suspended in the inks tend to agglomerate. Such agglomerates impede the droplet formation and likewise impair the typeface. Because the ink passes through the homogenization process described herein directly before the printing process, it is ensured that the ink which is used for printing allows a uniform droplet formation and that no disruptive agglomeration takes place in the ink because of the short time between homogenization and printing process.

The homogenization apparatus, irrespective of the position of the homogenization droplet catcher and the control of the charge tunnel, is preferably substantially identical in construction to the printhead in which the ink is to be used. In this way it is ensured that the ink allows an optimum droplet formation under the ambient conditions prevailing during the printing process.

BRIEF DESCRIPTION OF THE DRAWINGS

Embodiment examples of the invention are explained in more detail below with reference to the drawings. There are shown in.

DETAILED DESCRIPTION

Figure 1:
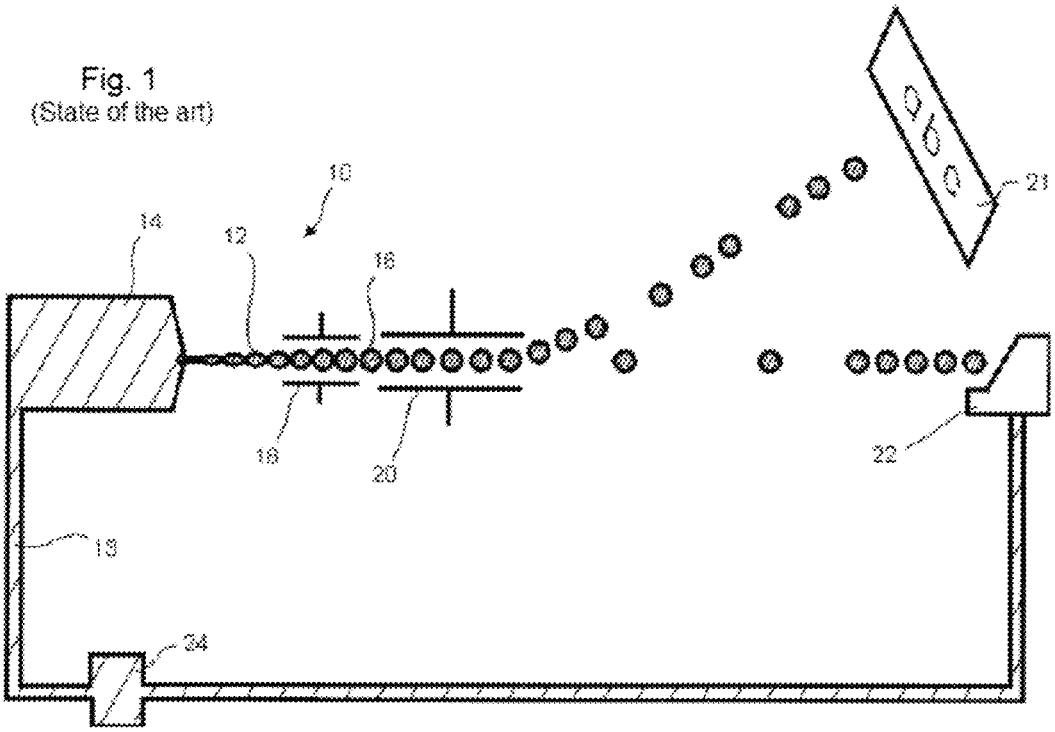
FIG. 1 a functional diagram of a conventional CIJ device according to the state of the art.

The structure of a conventional CIJ printhead 10 is represented in FIG. 1. An ink jet 12 is guided via a high-pressure line 13 to the printhead 10 and divided into individual equally large ink droplets 16 by way of a nozzle arrangement 14 which comprises an ultrasonic oscillator and a nozzle. A charge tunnel 18 serves to electrostatically charge the ink jet 12. An ink droplet 16 which separates from the charged ink jet 12 carries with it part of the charge. The charged ink droplets 16 are then guided by a deflection device 20, in which the ink droplets 16 are deflected from their original flight path corresponding to their charge/mass ratio. The surface is printed on by vertical deflection of the ink droplets 16 matched to each other and a corresponding horizontal movement of the printhead 10 or the surface 21 to be printed on. Ink droplets 16 that are not needed or are uncharged are left on their original flight path, received by a droplet catcher 22 and fed back into the reservoir 24.

Figure 2:
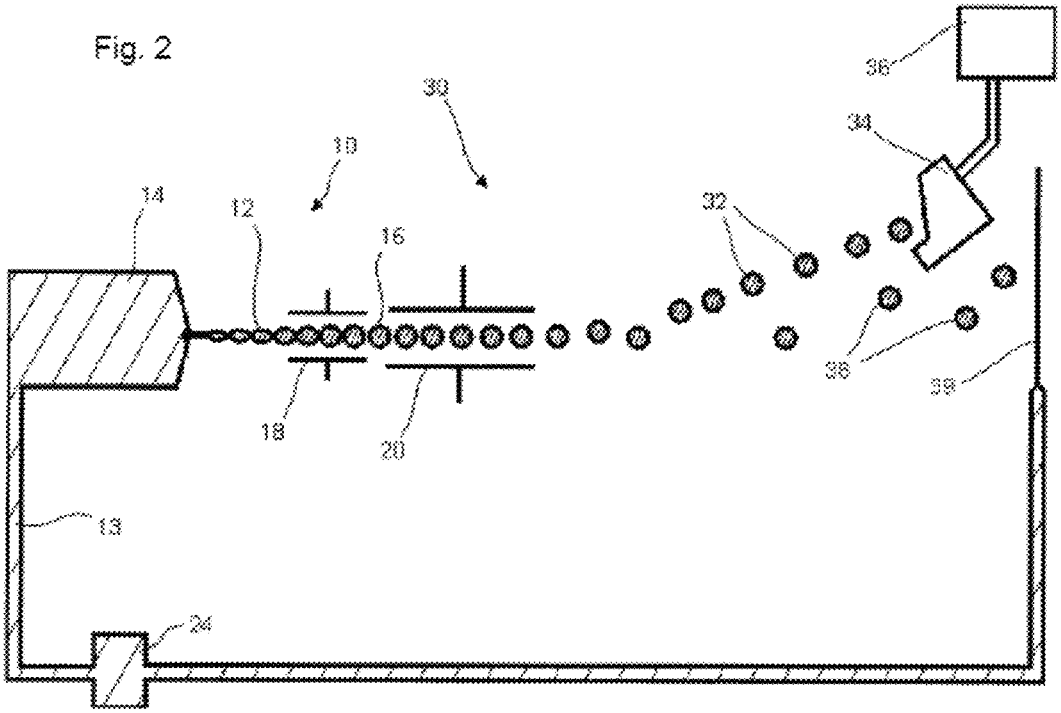
FIG. 2 the apparatus according to an embodiment of the invention for homogenizing ink for CIJ devices.

An embodiment of the homogenization device 30 according to an embodiment of the invention is depicted in FIG. 2. The structure of the homogenization device 30 largely corresponds to the structure of a conventional CIJ printhead 10. An ink jet 12 is again broken down into equally large ink droplets 16, wherein the charge tunnel 18 is configured such that the individual ink droplets 16 are in each case provided with an identical amount of charge. The charged ink droplets 16 are then deflected from their original flight path in the electrostatic field of the deflection electrode 20. The deflection of the ink droplets 16 depends on both the strength of the electrostatic field of the deflection electrode 20 and the charge/mass ratio of the ink droplets 16. The homogenization device 30 is adjusted such that those ink droplets 32 that have a previously fixed charge/mass ratio, and only those, strike a homogenization droplet catcher 34 and are conveyed from the latter into an intermediate container 36. While the droplet catcher 22 of FIG. 1 is arranged on the path of the undeflected ink droplets 16, the homogenization droplet catcher 34 is arranged such that only the homogeneous droplets 32 strike it. The predefined value of the charge/mass ratio depends individually on the respective ink and can be set by corresponding selection of the position of the homogenization droplet catcher 34, the pressure of the ink jet 12, the charging voltage in the charge tunnel 18, the voltage of the deflection electrode 20, as well as via the distance of the homogenization droplet catcher 34 from the charge tunnel 18. After an adjustment of the homogenization process or a phasing, a mutual influencing of the flight paths of successive ink droplets results because of electrostatic interactions and slipstream effects. In the course of the process, however, this flight path stabilizes, with the result that ink droplets with an identical charge/mass ratio then also have an identical flight path. The homogenization droplet catcher is therefore positioned, in the embodiment of FIG. 2, such that it collects the ink droplets with stabilized flight path.

The ink droplets 38 the deflection of which does not correspond to the value fixed by the position of the homogenization droplet catcher 34 on the other hand are deflected onto a different flight path and therefore do not strike the homogenization droplet catcher 34. These inhomogeneous ink droplets 38 are thus effectively separated from the homogeneous ink droplets 32. All ink droplets which do not strike into the homogenization droplet catcher, thus the inhomogeneous ink droplets and the homogeneous ink droplets which, at the start of the homogenization process, are still undergoing too small a deflection, on the other hand strike a deflector plate 39 and are conveyed back into the reservoir 24.

The ink which is collected in the intermediate container 36 consists exclusively of ink droplets 32 which had the desired charge/mass ratio. The ink formed from these ink droplets 32 has a high repeat accuracy, i.e., in a subsequent printing process this ink can be broken down again into ink droplets 32 with a consistent charge/mass ratio, with the result that a very clean typeface can be achieved.

Figure 3:
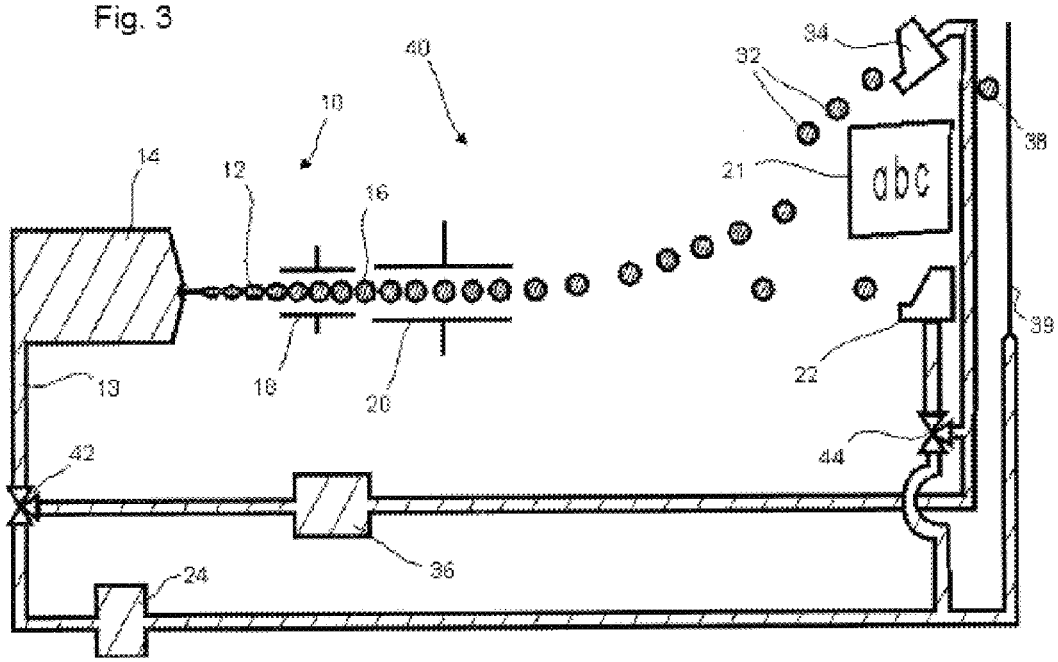
FIG. 3 a combined apparatus which is suitable both for printing and for homogenizing ink for CIJ devices.

A further embodiment of the homogenization apparatus 40 according to an embodiment of the invention is depicted in FIG. 3. In this embodiment, both the homogenization of the ink and the printing on a surface 21 can be carried out with the same printhead 10. This embodiment comprises, in addition to the homogenization apparatus 30 of FIG. 2, equipment, not represented in more detail, for holding and guiding a substrate with the surface 21 to be printed on and a customary droplet catcher 22. Via a 3-way valve 42, it is possible to select whether the printhead 10 is supplied with raw ink from the reservoir 24 or with homogenized ink from the intermediate container 36.

The customary droplet catcher 22 lies at the level of the nozzle arrangement 14, while the equipment for holding and guiding the substrate with the surface 21 to be printed on is arranged above this droplet catcher 22 and the homogenization droplet catcher 34 is arranged below the customary droplet catcher 22, or vice versa. The whole structure can also be tilted compared with the horizontal. It is important that the ink droplets 16 for printing receive an electric charge which is the opposite of the charge of the ink droplets 32, 38 which are used to obtain the homogeneous ink.

For printing, homogenized ink is guided from the intermediate container 36 into the printhead 10. The printing process is carried out, as described above. The ink droplets 16 are charged and guided via the deflection electrode 20 to their intended writing matrix position of the surface 21. Ink droplets 16 that are not needed are collected in the droplet catcher 22 and fed back into the intermediate container 36, in order to use the ink again in a later printing process. In idle periods or when the ink fill level in the intermediate container 36 becomes too low, the method for obtaining homogeneous ink can be carried out with the printhead 10. For this, the 3-way valve 42 is controlled such that the printhead 10 draws raw ink from the reservoir 24. As explained in connection with FIG. 2, the raw ink jet 12 is broken down into uniform and equally charged ink droplets 16. Those ink droplets 32 which have a predetermined charge/mass ratio are guided by the deflection electrode 20 into the homogenization droplet catcher 34 and conveyed from there into the intermediate container 36. Inhomogeneous ink droplets 38 which do not have the preset charge/mass ratio on the other hand are discarded. Ink droplets 16 which are received by the customary droplet catcher 22 during the homogenization process (e.g., during an adjustment of the apparatus) must not enter the intermediate container 36, but have to be fed back into the reservoir 24. For this reason, a further 3-way valve 44 is provided, with which it is possible to select into which container the ink is guided from the customary droplet catcher 22.

By way of example, a CIJ printing system from Videojet, Germany, EXCEL 2000 opaque type, was modified as follows:

The printhead was replaced by a printhead, including the 53-μm nozzle, made of quartz for 80 kHz and the software of a CIJ printer from Videojet, EXCEL 170i Ultra high speed type.

The tube of the droplet catcher was guided into a vacuum flask in order to ensure that only fresh ink is fed in.

By the incorporation of two boards and four potentiometers, the Excel electronics were modified such that more droplets than are needed for the writing can be charged, and the charging voltage and threshold values can be increased far beyond the normal extent. The same charge and highest deflection are thus compelled in all charged droplets. As all droplets have the same charge, a typeface is not produced, but all droplets are deflected to the maximum extent. The efficiency of the droplet collection is hereby drastically increased.

A vertically and laterally adjustable homogenization droplet catcher was fitted on a base plate parallel to the modifications of the printer. The homogenization droplet catcher is a small metal tube, the end of which is bent horizontal and has an opening with a clear diameter of 1 mm. This trap for the homogenized ink droplets opens into a flask which can be charged with negative pressure.

This design is movable, and thus a continuous adjustment of the distance to the printhead or flight path of the ink droplet is possible by positioning the printhead.

In combination with the electronics modification and the associated possibility of charging a large number of droplets and deflecting the generated droplets higher, this structure opens up a possibility of homogenizing ink droplets, wherein the properties of the droplets, size or mass, can be controlled within a large range by lengthening the flight path and varying the charging voltage.

The distance of the homogenization droplet catcher from the printhead was 50 mm in most tests. Some tests were also run with a distance of 70 mm.

The longer the flight path and the higher the deflection, the more narrow the particle-size fraction of the homogenized droplets.

The ink droplets are generated and charged. The charging voltage in CIJ printing was between 70 and 275 volts. This is the normal voltage of a full matrix of 16×24 ink droplets (h×w). The phasing droplets have 10 volts. To obtain homogeneous ink, the charging voltage for all ink droplets was raised to 210 volts by way of the modified electronics. At this charging voltage, no interactions of the ink droplets are noticeable. All ink droplets which have not received a charge are fed back via the standard droplet catcher. The threshold value is 50 volts in order to allow the phasing droplets which are charged with 10 volts through and not to bring them to a higher level.

The charged droplets are deflected at the high-voltage board and, if they are qualified, i.e., homogenized, ink droplets, are collected via the homogenization droplet catcher.

Ink droplets which are not deflected according to the specification—because of smaller or larger mass or charge—are collected at the deflector plate or in the periphery. These ink droplets are collected and discarded.

This design delivers approx. 250 ml homogenized ink, which showed a very good performance in different printing systems, within 3.5 h. The thus-obtained printer ink was used for CIJ printing. For this, the viscosity of the printer ink was first set in order to compensate for the evaporation losses which occur when the homogeneous ink is obtained. While 5 to 10% incorrect charges occurred in printing tests with the non-homogenized raw ink, the incorrect charges when the homogenized ink was used were below 1%.

LIST OF REFERENCE NUMBERS

10 Printhead
12 Ink jet
13 High-pressure line
14 Nozzle arrangement
16 Ink droplets
18 Charge tunnel
20 Deflection electrode
21 Surface to be printed on
22 Droplet catcher for printing
24 Reservoir
30 Homogenization apparatus
32 Homogeneous ink droplets
34 Homogenization droplet catcher
36 Intermediate container
38 Inhomogeneous ink droplets
39 Deflector plate
40 Combined homogenization/printing apparatus
42 3-way valve
44 Further 3-way valve

The invention claimed is:

1. A method for obtaining homogeneous ink for inkjet devices, comprising:
- dividing an ink jet into individual equally large ink droplets;
- providing at least some of the ink droplets with an electric charge;
- guiding the ink droplets through a deflection device;
- collecting a portion of the ink droplets which is deflected by a predefined amount by a homogenization droplet catcher, wherein each ink droplet of the collected portion has a fixed charge-to-mass ratio corresponding to the predefined amount of deflection; and
- utilizing the ink droplets collected by the homogenization droplet catcher in a printing operation.

2. The method according to claim 1, further comprising providing each ink droplet with a same electric charge.

3. The method according to claim 1, wherein the flight length of the ink droplets is more than 50 mm.

4. The method according to claim 3, wherein the flight length of the ink droplets is more than 70 mm.

5. The method according to claim 1, further comprising storing the ink droplets which are collected by the homogenization droplet catcher in an intermediate container.

6. An apparatus for obtaining homogeneous ink for inkjet devices, comprising:
- an equipment for generating an ink jet;
- a nozzle arrangement, comprising an ultrasonic oscillator and a nozzle, for dividing the ink jet into individual equally large ink droplets;
- a charge tunnel, with which each ink droplet is provided with electric charge;
- a deflection device, with which the individual electrically charged ink droplets are deflected; and
- a homogenization droplet catcher that is arranged at a position to collect a portion of the ink droplets which is deflected by a predefined amount, wherein each ink droplet of the collected portion has a fixed charge-to-mass ratio corresponding to the predefined amount of deflection.

7. The apparatus according to claim 6, wherein the deflection device comprises a generator that generates an electrostatic or magnetostatic field for deflecting the ink droplets.

8. The apparatus according to claim 6, further comprising an intermediate container for storing the ink droplets collected by the homogenization droplet catcher.

9. The apparatus according to claim 6, which is usable both for obtaining homogeneous ink and for printing on a surface using the homogeneous ink, further comprising:

an equipment for holding and guiding a substrate with a surface to be printed on; and a droplet catcher which is arranged such that the droplet catcher collects the undeflected ink droplets not needed for the printing.

10. The apparatus according to claim 9, wherein the equipment for holding and guiding the substrate with the surface to be printed on and the homogenization droplet catcher are arranged on opposite sides of the droplet catcher for the undeflected ink droplets.

11. The apparatus according to claim 10, wherein:

the equipment for holding and guiding the substrate with the surface to be printed on is arranged above the droplet catcher for the undeflected ink droplets; and the homogenization droplet catcher is arranged below the droplet catcher for the undeflected ink droplets.

* * * * *